US005558556A

United States Patent [19]

Froehlich

[11] Patent Number: 5,558,556

[45] Date of Patent: Sep. 24, 1996

[54] SUPPORT DEVICE FOR A BRASSIERE STRAP

[76] Inventor: Harry W. Froehlich, 1344 Marinette Rd., Pacific Palisades, Calif. 90272

[21] Appl. No.: 415,431

[22] Filed: Apr. 3, 1995

[51] Int. Cl.[6] ..... A41D 27/26

[52] U.S. Cl. ..... 450/86; 2/267; 2/268

[58] Field of Search ..... 2/1, 2, 267, 268, 2/73, 22, 23, 24; 450/86; 224/264; 297/482

[56] References Cited

U.S. PATENT DOCUMENTS

| | | | |
|---|---|---|---|
| 2,587,101 | 2/1952 | Blalock et al. | 2/2 |
| 2,643,380 | 6/1953 | Blair | 297/482 X |
| 2,699,550 | 1/1955 | Freid | 2/2 |
| 2,823,383 | 2/1958 | Crawford . | |
| 2,823,384 | 2/1958 | Eilertsen . | |
| 3,154,787 | 11/1964 | Newman | 2/268 |
| 3,229,694 | 1/1966 | Koropp . | |
| 4,575,874 | 3/1986 | Johnson . | |
| 4,612,935 | 9/1986 | Greifer | 2/268 |
| 4,638,513 | 1/1987 | Woods . | |
| 4,795,399 | 1/1989 | Davis . | |
| 4,795,400 | 1/1989 | Greenberg . | |
| 4,811,876 | 3/1989 | Riggi . | |
| 4,887,318 | 12/1989 | Weinreb | 2/268 |
| 4,945,576 | 8/1990 | Melton . | |
| 5,201,078 | 4/1993 | Melton . | |

*Primary Examiner*—Jeanette E. Chapman
*Attorney, Agent, or Firm*—William W. Haefliger

[57] ABSTRACT

In apparatus attachable to a strip of material associated with a garment, the combination comprising a flexible support base, and two foldable flaps carried by the base at spaced apart fold locations, and characterized in that the flaps are separately foldable from open positions allowing placement of the strip part at least one open position flap and toward the base, to closed position in which portions of the flaps directly overlie one another and the strip is retained to the base by the flaps; the flaps consisting of mutually face-to-face adherent material to adhere when the portions are pressed together in the closed position of the flaps.

15 Claims, 4 Drawing Sheets

SUPPORT DEVICE FOR A BRASSIERE STRAP

BACKGROUND OF THE INVENTION

This invention relates generally to clothing support, and more particularly to apparatus attachable to a strip of material associated with a garment, to support the garment.

Support devices have been provided in the past to alleviate the problem of discomfort and chafing created by bra strap rubbing and excessive load imposition on wearer's shoulders. Women with full figures commonly suffer such discomfort and chafing. Such devices have included pads that can be pinned to bra straps, for example; however pinning can be difficult, and the strap on the pad remains exposed to the covering garment, which can then deflect and show at the shoulders, particularly regarding sheer dresses.

There is need for improved devices which provide cushioned support at the shoulder and also provide for strap concealment in a manner that offers smoothing directly under the overgarment, eliminating the problem of showing of the strap or cushion by garment deflection.

SUMMARY OF THE INVENTION

It is a major object of the invention to provide an improved support device or apparatus, which is attachable to a strip of material associated with a garment, and which eliminates the above problems. Basically, the apparatus of the invention comprises:

a) a flexible support base, and b) two foldable flaps carried by the base at spaced apart fold locations, and characterized in that the flaps are separately foldable from open positions allowing placement of the strip past at least one open position flap and toward the base, to closed position in which portions of the flaps directly overlie one another and the strip is retained to the base by the flaps, c) the flaps consisting of mutually face-to-face adherent material to adhere when the portions are pressed together in closed position of the flaps.

It is found that thin flexible vinyl flaps are well suited to adhere when pressed down upon one another while flexing to conform to the shoulder curvature of the underlying base.

As will appear, the flaps are typically retained to the base to project freely from the fold locations; and such fold locations are generally linear and substantially parallel. Also each flap projects from its associated fold location toward the other flap fold location in flap closed positions.

The flaps typically have length dimensions lengthwise of the fold locations, and width dimensions perpendicular to such length dimensions, the length dimension of each flap substantially exceeding its width dimension.

It is another object of the invention to provide the flexible base in the form of a pad or cushion consisting of fabric material underlying the vinyl flaps so that they need not come in contact with the wearer's skin. The pad is elongated in the direction of linear fold elongation, to assume the front to rear curvature of the wearer's shoulder, whereby curvature of the flap fold assists retention of the flaps in closed or folded condition.

Yet another object is to provide the cushion with an upper layer adjacent the flaps, and a lower layer spaced below the upper layer, and including edge binding connecting the layers along edges thereof. That upper layer may be white to conceal possible discoloration of the cushion, the upper layer being visible through the flap, which may be transparent and flexible.

These and other objects and advantages of the invention, as well as the details of an illustrative embodiment, will be more fully understood from the following specification and drawings, in which;

DRAWING DESCRIPTION

DETAILED DESCRIPTION

Figure 1:
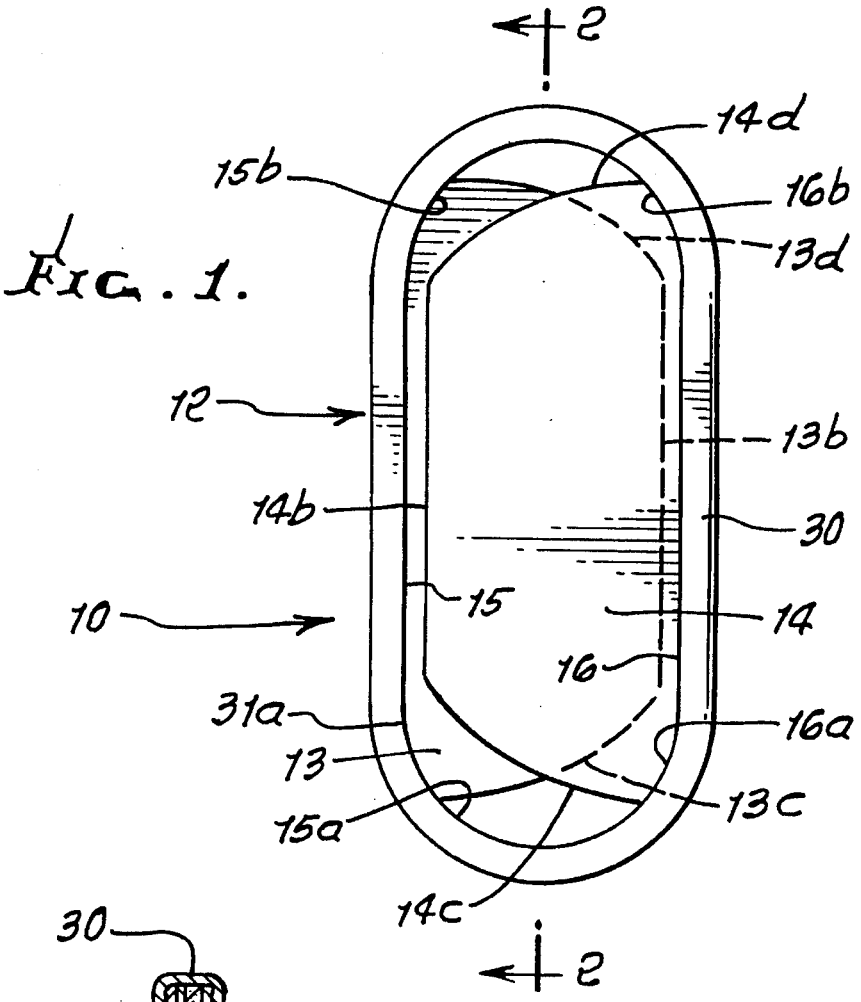
FIG. 1 is a plan view of an apparatus constructed in accordance with the invention.
Figure 2:
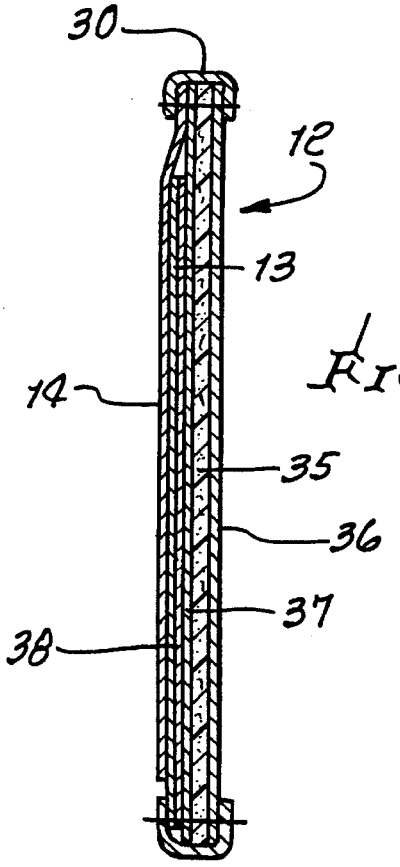
FIG. 2 is a section taken on lines 2—2 of FIG. 1.
Figure 4:
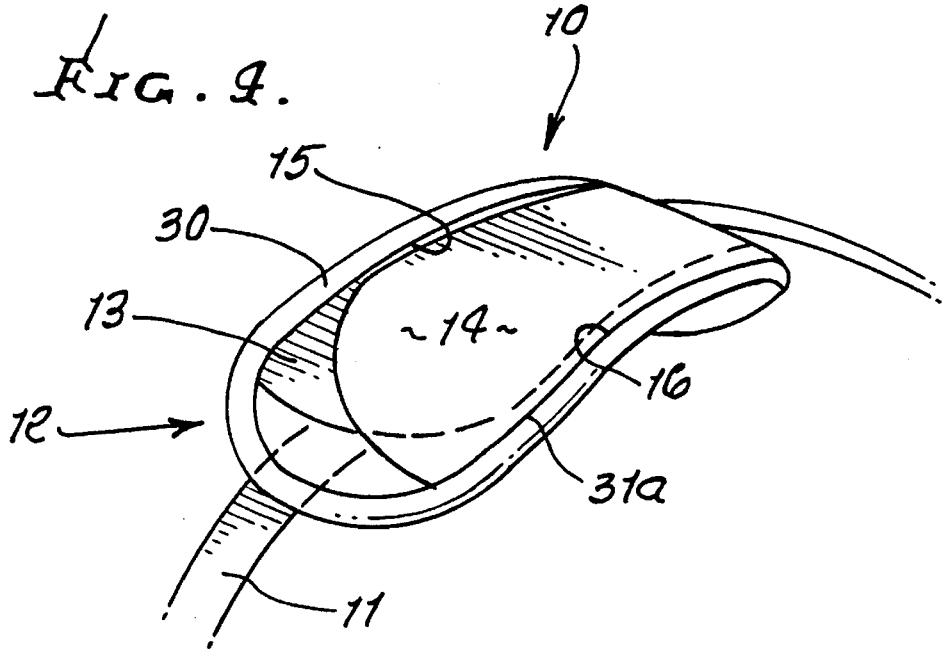
FIG. 4 is a perspective view of the FIG. 1 device, in use as in FIG. 3.
Figure 3:
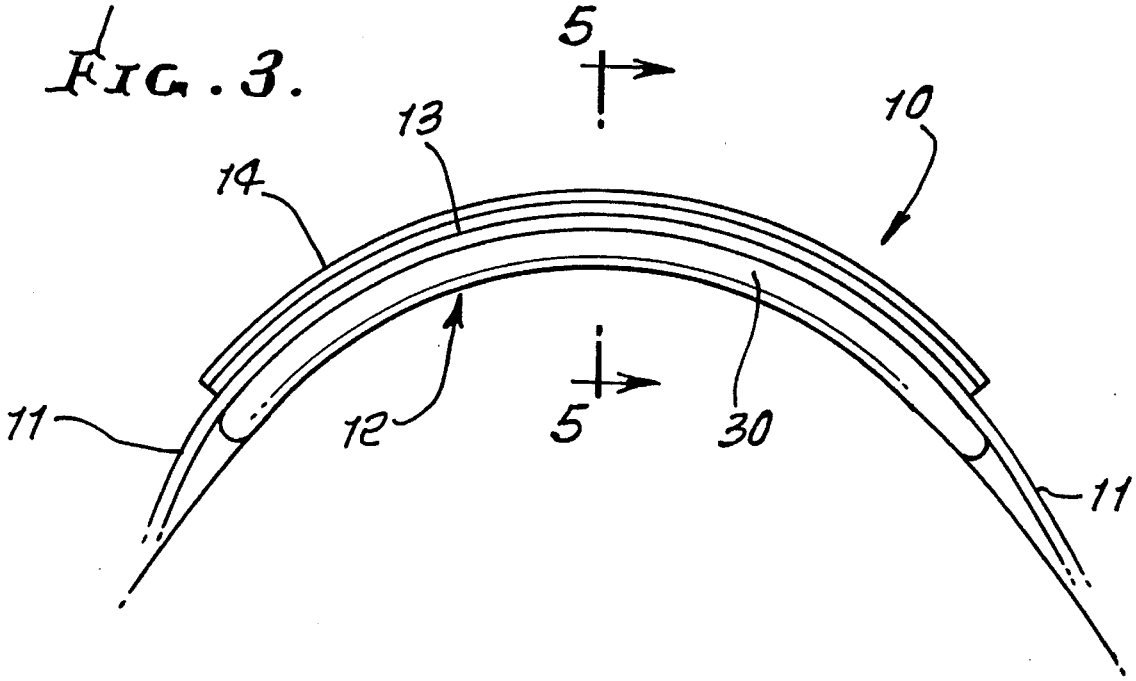
FIG. 3 is a side view of the FIG. 1 device as it extends over the shoulder of a wearer.
Figure 5:
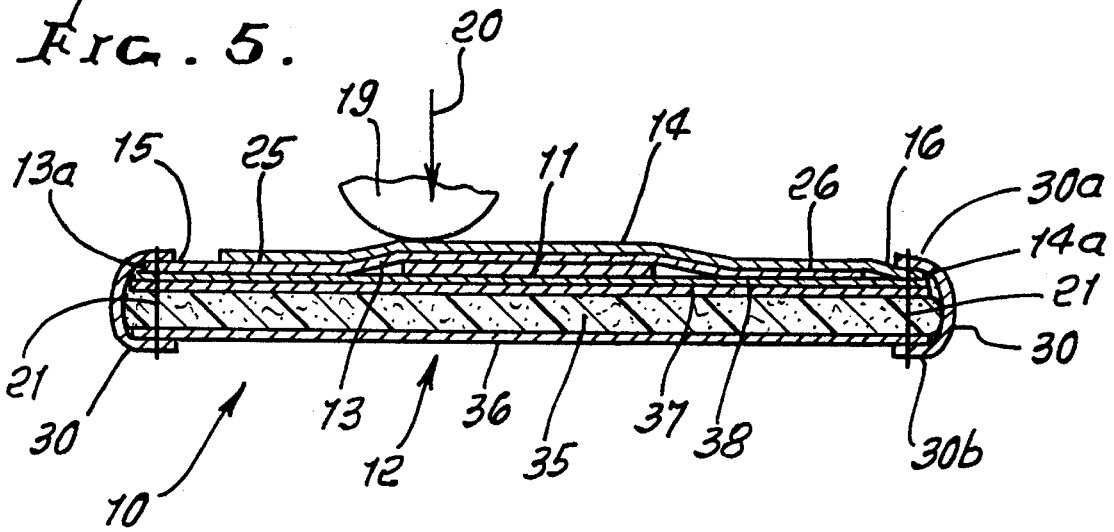
FIG. 5 is an enlarged section taken on lines 5—5 of FIG. 3.

As seen in FIGS. 1 and 2, the apparatus 10 is attachable to a strip of material associated with a garment. FIGS. 3–5 show one type strip of material, in the form of a lingerie strap, such as a bra strap 11.

The apparatus 10 as seen in FIGS. 1–5 includes a flexible support base generally indicated at 12, and two foldable flaps 13 and 14 carried by the base at spaced fold locations 15 and 16. The flaps are supported so as to be separately foldable from open position (see FIG. 6 for example) allowing downward placement of the strap 11 past at least one open position flap and toward the base, to supported position, to closed position (see FIG. 5) in which portions of the flap directly overlie one another, and the strap is retained to the base 12 by the flaps. The two flaps include mutually adherent face to face material to adhere when the overlapping flap portions are manually pressed together, in closed position of the flap as seen in FIGS. 1–5. See in FIG. 5 downward pressure exerted by the user's finger 19. Note pressure indicating arrow 20.

Figure 6:
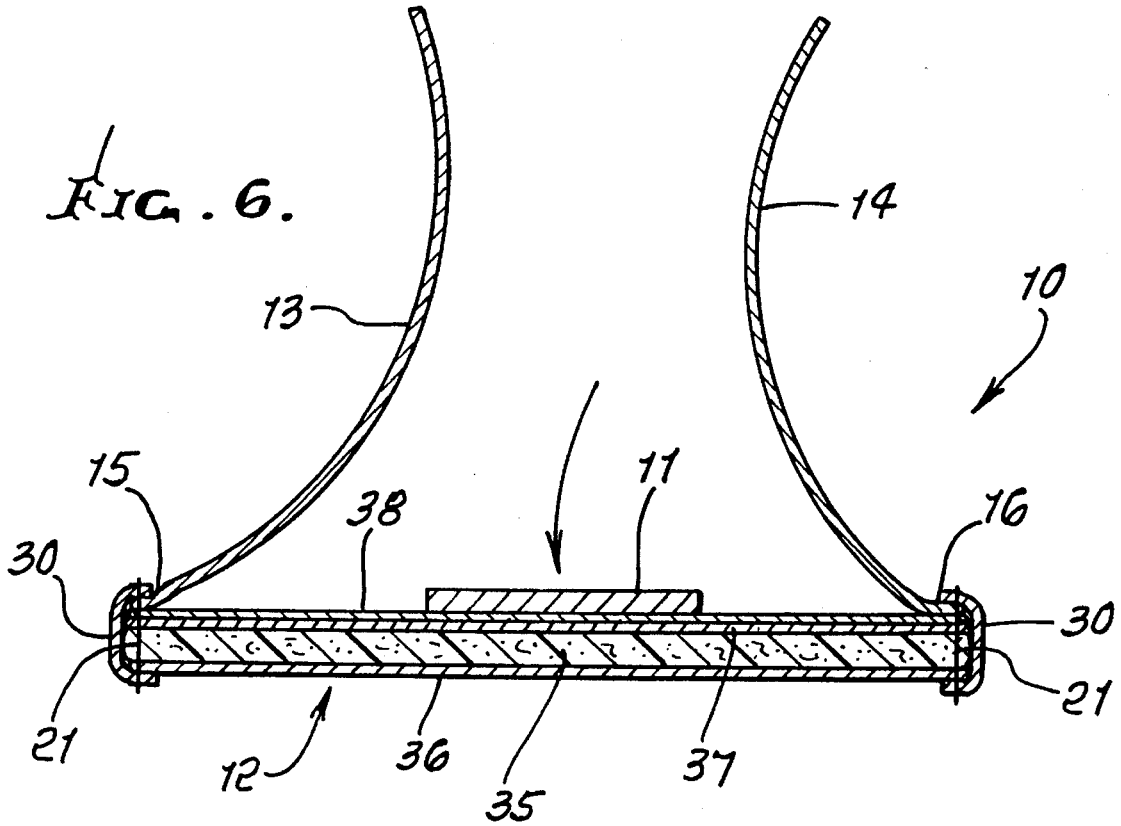
FIG. 6 is a view like FIG. 5, but showing the flaps elevated to a position allowing downward placement of a garment strip or strap in supported position on the base, or upward removal of the strip or strap off and away from the base.

Flap 13 has an elongated edge portion 13*a* retained to the pad or base 12 by seam binding 30 and stitching 21 as viewed in FIGS. 5 and 6. Retained edge portion 13*a* has associated flap fold arcuate opposite ends 15*a* and 15*b*, which act to exert force tending to keep flap 13 in down or closed position (see FIG. 5) in use, i.e. it resists flap 13 upward folding. Flap 13 also has an elongated free edge portion 13*b*, and arcuate opposite end edge portions 13*c* and 13*d*.

Likewise flap 14, a mirror image of flap 13, has an elongated edge portion 14*a* retained to the pad or base 12 as by looping seam binding 30 and stitching 21, as viewed in FIGS. 5 and 6. Retained edge portion 14*a* has associate flap fold arcuate opposite ends 16*a* and 16*b* which act to exert force tending to keep flap 14 in down or closed position (see FIG. 5) in use, i.e. it resists flap 14 upward un-folding. Flap 14 also has an elongated free edge portion 14*b*, and arcuate opposite end portions 14*c* and 14*d*. Such flap end edge portions 13*c* and 14*c* criss-cross and are so related as to not coincide, allowing the user's fingers to peel the flaps apart and raise them to FIG. 6 position. Opposite flap end edge portions 13*d* and 14*d* have the same relationship, and serve the same function. Note that free edge portion 13*b* lies close to fold 16; and free edge 14*b* lies close to fold 15, for near maximum overlap, and enhanced flap-to-flap retention.

Folds 15 and 16 extend lengthwise of the elongated base or pad to assume over the shoulder curvature as seen in FIGS. 3 and 4. Such fold curvature further resists unfolding of the flaps, when pressed together. Folds 15 and 16 are generally parallel, with linear mid-portions as seen in FIG. 1.

Note in FIG. 5 that each flap 13 and 14 projects from its associated fold location toward the other flap fold location, in flap closed positions. In FIG. 6 the flaps are shown as projecting freely upwardly from their respective fold locations to allow strap 11 placement downwardly therebetween, and subsequent flap down folding to FIG. 6 position. The two flaps adhere to one another when they are in superposed contact, as for example at interfaces 25 and 26 at opposite sides of strap 11. The use of vinyl flap material such as calendared flexible film with double polished surface provides the desire adherence or retention, for strap retention therebelow, while allowing selective upward peeling of the upper flap away from the lower flap, as desired. The strap 11 itself may be shifted lengthwise, beneath the flaps in FIGS. 4 and 5 condition, for adjustment purposes whereby the support apparatus may be adjusted on the shoulder relative to the strap. Additional properties of the vinyl flap material are:

| | | |
|---|---|---|
| Grade: | KGOC, KGAC | |
| Gauge: | 12–16G | |
| Hand: | 2S–3S | |
| Finish: | Double Polish | |
| Color: | Clear | |
| Tensile Strength (ASTM D 002) | | |
| * | Machine Direction | 3600–3800 psi |
| * | Transverse Direction | 3200–3600 psi |
| Elongation (ASTM D 882) | | |
| * | Machine Direction | 300–320% |
| * | Transverse Direction | 310–330% |
| 100% Modulus (ASTM D 882) | | |
| * | Machine Direction | 1600–1800 psi |
| * | Transverse Direction | 1400–1600 psi |
| Density (ASTM D 1505) 1.25–1.26 g/cm$^3$ | | |

The flaps in one desirable form may have length dimensions, i.e. lengthwise of the fold locations, and width dimensions perpendicular to such length dimensions, where the length of each flap substantially exceeds it width. The pad itself preferably has length of between four and five inches, and preferably about 4½ inches; and width of between 1½ and 2½ inches, and preferably about 2 inches. Pad thickness is between 1/16 and 3/16 inch, for example. Note that the edge binding 30 extends in a loop about the pad or cushion, and stitching 21 and 21*a* attaches the seam binding to the flaps and to the pad structure, whereby the fold locations 15 and 16 are spaced inwardly from the extreme outer edges of the structure. The visible stitching line also extends in a loop as indicated at 31*a* in FIG. 4 and also in FIG. 1. Stitching interconnects the upper and lower edges 30*a* and 30*b* of the seam binding.

The pad preferably comprises a composite of fabric and cushion layers. See for example in FIG. 2 the relatively thicker foam layer 35, and the thinner under layer 36 typically consisting of brushed (NYLON) tricot. The upper layer 37 adjacent the layer 35 typically consists of 40 denier NYLON tricot material; or other opaque fabric and a dressy lace layer 38 may overlie 37, for slidable surface engagement with the strap 11. Cushion layer 35 may consist of synthetic resin foam (such as polyurethane), or rubber or elastomeric foam, or FIBERFIL, or other cushion material.

The cushion layer 35 is typically resiliently yieldable, to resiliently resist bending.

Figure 7:
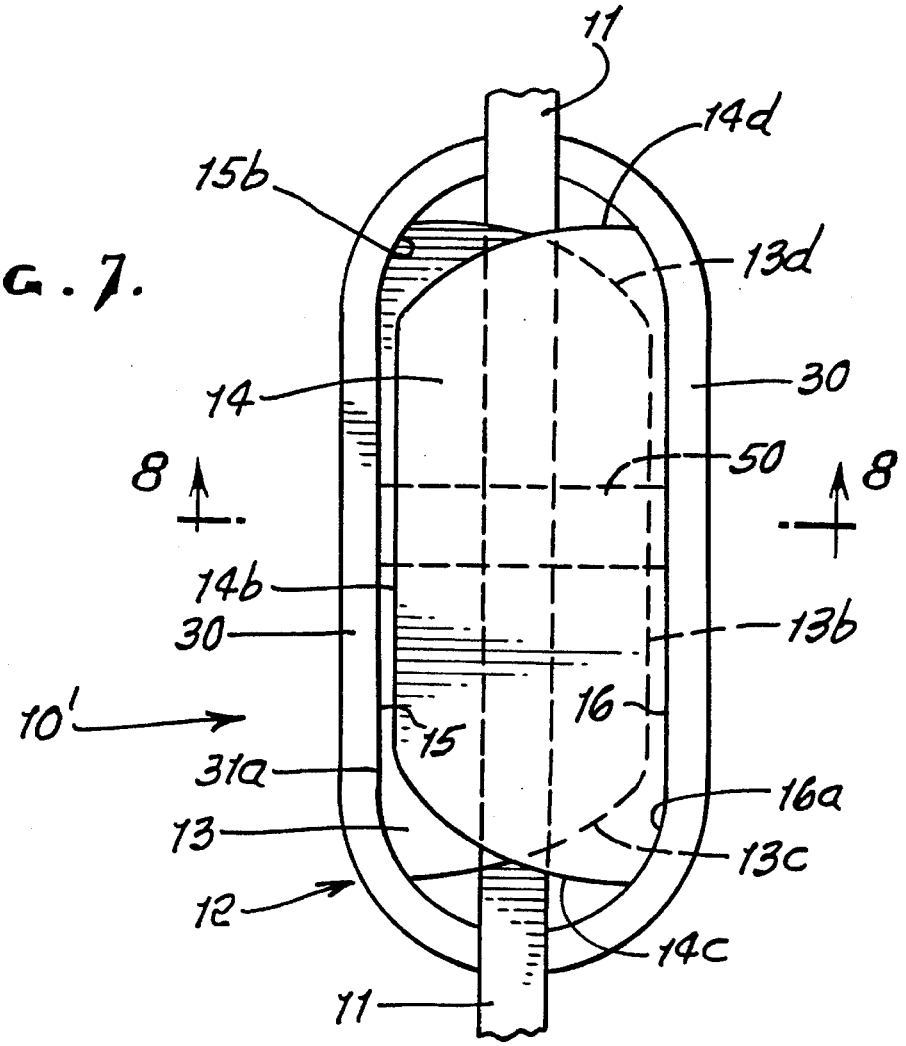
FIG. 7 is a view like FIG. 1, but showing a modification.
Figure 8:
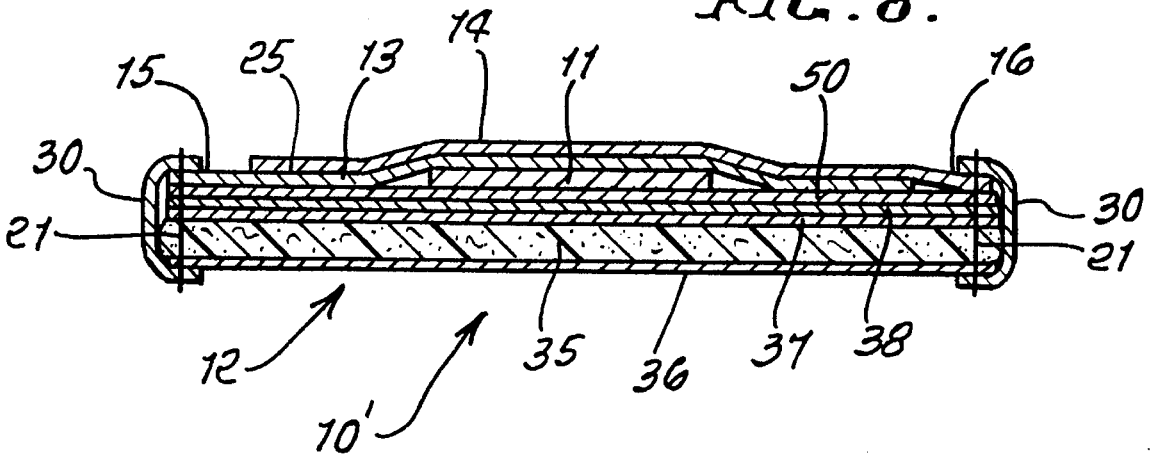
FIG. 8 is an enlarged section taken on lines 8—8 of FIG. 7.

The modified apparatus seen at 10' in FIGS. 7 and 8 is like that of FIGS. 1–6, corresponding elements bearing the same identification numbers. In addition, it includes an additional relatively narrow layer or band 50 that extends crosswise of the flaps and between the base 12 and the flaps 13 and 14. The garment strip of material, as for example bra strap 11, extends between the flaps 13 and 14 and the band 50, i.e. over the band and beneath the flaps. The composite elements 13, 14 and 50, in flap closed position, co-act to resist relative slippage of the strip or strap 11, as for example sidewise. The opposite ends of the band 50 are anchored to the cushion, as by stitching 21, as seen in FIG. 8. Band 50 may be about 1 inch to 1½ inches in width.

I claim:

1. In apparatus attachable to a strip of material associated with a garment, the combination comprising a) a flexible support base, and b) two foldable flaps carried by said base at spaced apart fold locations, and characterized in that the flaps are separately foldable from open positions allowing placement of said strip past at least one open position flap and toward the base, to closed position in which portions of the flaps directly overlie one another and the strip is retained to the base by the flaps; the flaps consisting of mutually face-to-face adherent material to adhere when the portions are pressed together in the closed position of the flaps, c) said flaps being retained to the base to project freely from said fold locations, d) said fold locations being linear and substantially parallel, but each with fold end curvature, toward an extended line defined by the other flap linear fold location, e) each flap projecting throughout its major length from its associated linear fold location toward and into proximity to the other flap associated linear fold location in said flap closed positions, f) said flaps consisting of vinyl material, and being transparent, flexible and mutually adherent.

2. The combination of claim 1 wherein said flaps have length dimensions lengthwise of said fold locations, and width dimensions perpendicular to said length dimensions, said length dimension of each flap substantially exceeding its width dimension.

3. The combination of claim 1 wherein said base comprises a pad having a resiliently yieldable layer, the flaps consisting of vinyl plastic material.

4. The combination of claim 1 wherein said base comprises a shoulder cushion which is elongated in the direction of elongation of at least one linear fold location.

5. The combination of claim 4 wherein said cushion has length in said elongation direction of about 4½ inches, width of about 2 inches, and thickness between 1/16 and 3/16 inches.

6. The combination of claim 4 wherein said cushion has an upper layer adjacent said flaps, and a lower layer spaced below said upper layer, and including edge binding connecting said layers along edges thereof.

7. The combination of claim 6 wherein said upper layer consists of 40 denier NYLON tricot material.

8. The combination of claim 7 wherein said lower layer consists of brushed tricot.

9. The combination of claim 4 wherein said cushion includes an upper layer directly underlying said flaps, said upper layer being opaque.

10. The combination of claim 1 including said strip of material retained between said base and said flaps in said closed position thereof.

11. The combination of claim 10 wherein said strip of material comprises a lingerie strap, and extends in the direction of flap elongation, and between the flaps and said base.

12. The combination of claim 1 including an additional relatively narrow layer extending crosswise of said flaps and between the base and said flaps, said additional layer acting with the flaps in said closed position thereof to resist relative slippage of said strip of material that extends between said additional layer and said flaps.

13. The combination of claim 12 wherein said layer consists of vinyl material.

14. The combination of claim 13 wherein said vinyl material is a double polished fiber.

15. The combination of claim 3 wherein said vinyl plastic material is a calendared flexible fiber with double polished surfaces.

* * * * *